US011753129B1

(12) United States Patent
Kelley et al.

(10) Patent No.: US 11,753,129 B1
(45) Date of Patent: Sep. 12, 2023

(54) HYDRO PROPULSION APPARATUS

(71) Applicants: Ralph Kelley, Las Vegas, NV (US); Cynthia Kelley, Las Vegas, NV (US)

(72) Inventors: Ralph Kelley, Las Vegas, NV (US); Cynthia Kelley, Las Vegas, NV (US)

( * ) Notice: Subject to any disclaimer, the term of this patent is extended or adjusted under 35 U.S.C. 154(b) by 239 days.

(21) Appl. No.: 17/329,015

(22) Filed: May 24, 2021

Related U.S. Application Data

(60) Provisional application No. 63/101,941, filed on May 26, 2020.

(51) Int. Cl.

| | |
|---|---|
| ***B63H 21/17*** | (2006.01) |
| ***B63C 11/02*** | (2006.01) |
| ***B63H 21/21*** | (2006.01) |
| ***B63H 1/14*** | (2006.01) |

(52) U.S. Cl.
CPC ..... *B63H 21/17* (2013.01); *B63C 11/02* (2013.01); *B63H 1/14* (2013.01); *B63H 21/213* (2013.01)

(58) Field of Classification Search
CPC ..... B63H 21/17; B63H 21/213; B63H 1/14; B63C 11/02
See application file for complete search history.

(56) References Cited

U.S. PATENT DOCUMENTS

| | | | | |
|---|---|---|---|---|
| 4,016,616 | A * | 4/1977 | Walters | B63C 11/46 114/315 |
| 5,947,782 | A * | 9/1999 | Siladke | A63H 23/10 441/132 |
| 10,556,151 | B1 * | 2/2020 | Malykhin | B63B 32/20 |
| 2009/0258554 | A1 * | 10/2009 | Gutierrez | B63C 9/24 441/106 |
| 2015/0209622 | A1 * | 7/2015 | Guinyard | B63C 11/02 440/38 |

* cited by examiner

*Primary Examiner* — Stephen P Avila
(74) *Attorney, Agent, or Firm* — Lewis Roca Rothgerber Christie LLP

(57) ABSTRACT

An apparatus comprising one or more propulsion units that are operable to help propel a user in water. The propulsion units are battery operated, such as with a rechargeable battery, and are selectively operable to create a propulsion force in water. The propulsion force propels the apparatus in water. A person wearing the apparatus, such as in the form of a vest, is propelled in water with the apparatus.

19 Claims, 4 Drawing Sheets

HYDRO PROPULSION APPARATUS

PRIORITY

This patent application claims priority to U.S. Provisional Patent Application Ser. No. 63/101,941, filed May 26, 2020, whose entire disclosure is incorporated herein by reference.

FIELD OF INVENTION

This invention concerns aquatic devices, and more specifically, to an apparatus for propulsion in water.

BACKGROUND

Water sports are popular for users around the world. These include, for example, swimming, water skiing, boating, jet skiing, scuba diving, and the like. Safety is an important concern while engaging in such water activities. Usually, one engaged in water-based activities must wear a floatation vest to help prevent the possibility of drowning.

Even with a floatation vest, the possibility of drowning is an ever-present danger. Often times this is caused by fatigue, resulting from a laborious engagement in the sport or from being forced to travel a distance to reach a boat, a shore, or the like. For example, when a water skier falls, he must travel through the water to reach the boat. This effort becomes more cumbersome if the person is wearing a floatation device, such as a life jacket or a buoy. The fatigue increases as the process is repeated a few times, when the person falls, swims back to the boat, and resumes skiing.

Similarly, if a swimmer is swimming a long distance, but fatigue or a medical issue occurs, the swimmer has no choice but to continue the laborious swimming in order to reach safety. This is a physically strenuous process, not ideal for a person who is already fatigued or is undergoing a medical issue.

Scuba diving, snorkeling, and the like, have increased in popularity during the recent years. One engaging in these activities attempts to traverse some distance while engaging in the activity. Maneuvering in water, especially while saddled with heavy equipment, is a slow and cumbersome task. Some devices are available to assist in the process, such as a scooter that the person may hold. However, these devices are cumbersome and their operation requires the user's arms and hands, which deprives him of the freedom to be able to use his arms and hands.

Accordingly, there is a need for a means to assist a person travel in water safely and comfortably, without encumbering the person's arms and hands, and without impeding his mobility.

COPYRIGHT NOTICE

© 2021, Ralph Kelley and Cynthia Kelley. The disclosure in this patent document includes material that is subject to copyright protection. The copyright owner consents to fair use by facsimile reproduction of the patent document or of the patent disclosure as it appears in the U.S. Patent and Trademark Office's records. Apart from that, all copyright rights to the disclosure herein are expressly reserved. 37 CFR § 1.71(d).

SUMMARY OF THE INVENTION

An apparatus is provided, that has means to make it attachable to a user's body. In one embodiment, the apparatus is a vest worn on the user's torso. The apparatus may be made from a high buoyancy material which will help the user float in water. The apparatus includes a fastening means to help secure or release the apparatus from the user's body.

The apparatus comprises a propulsion unit, which is operable to generate thrust in water. The propulsion unit comprises a casing that defines a cavity inside the casing. A battery, preferably a rechargeable battery, is substantially rigidly implemented in the cavity. The battery is electrically connected to a motor. The motor is operatively connected to a propulsion mechanism, which is operable to create thrust in water. The propulsion mechanism's speed may be selectively controlled by the user in order to achieve a desired amount of thrust in water.

The propulsion mechanism is a propeller in one embodiment. The propulsion unit has an inlet means and an outlet means, and the propeller is operable to make water flow from the inlet means to the outlet means, which waterflow creates thrust for the apparatus and for the user wearing the apparatus.

In one embodiment the apparatus includes a pocket that is substantially rigidly attached to the apparatus. The pocked defines a cavity inside the pocket, and the dimensions of the cavity conform to the dimensions of the propulsion unit. The propulsion unit may be selectively implemented in, or removed from, the cavity in the pocket. The cavity in the pocket may also include an attachment means to hold the propulsion unit in the pocket.

In alternate embodiments a plurality of propulsion units may be attached to the apparatus, which collectively produce more cumulative thrust for the apparatus. The plurality of propulsion units are preferably implemented in the apparatus in a substantially parallel configuration with respect to each other.

In one embodiment, the apparatus is a vest with two pockets, with one pocket positioned on each side of the user's body under the user's arm area. The cavity in each pocket includes a propulsion unit. Such placement of two propulsion units, one on each side of the user's torso, help provide a balanced and effective propulsion for the user in water.

The pockets in the apparatus may be formed integrally with the vest. Alternatively, the pockets are formed of a stretchable material that stretches to accommodate a propulsion unit in the cavity therein and snugly holds the propulsion unit in the cavity.

Another embodiment may comprise a safety member, such as a strap, to help hold the apparatus to the user's body. In one embodiment the apparatus is a vest and the safety member is a strap attachable near the user's crotch area, and may be wrapped around the user's crotch area to effectively form a jock strap.

BRIEF DESCRIPTION OF THE FIGURES

The invention can be better understood with reference to the figures. In the figures, like reference numerals designate corresponding parts throughout the different figures and views.

DETAILED DESCRIPTION

The systems, methods, and apparatus of the present invention are described below with reference to the figures. The description and figures are for illustrative purposes only, they do not limit the true scope and spirit of the present invention. The true scope and spirit of the present invention is evidenced by all parts of the disclosure herein, including but not limited to the Summary, the Figures, the Detailed Description, and the Claims, along with equivalents thereof.

Figure 1:
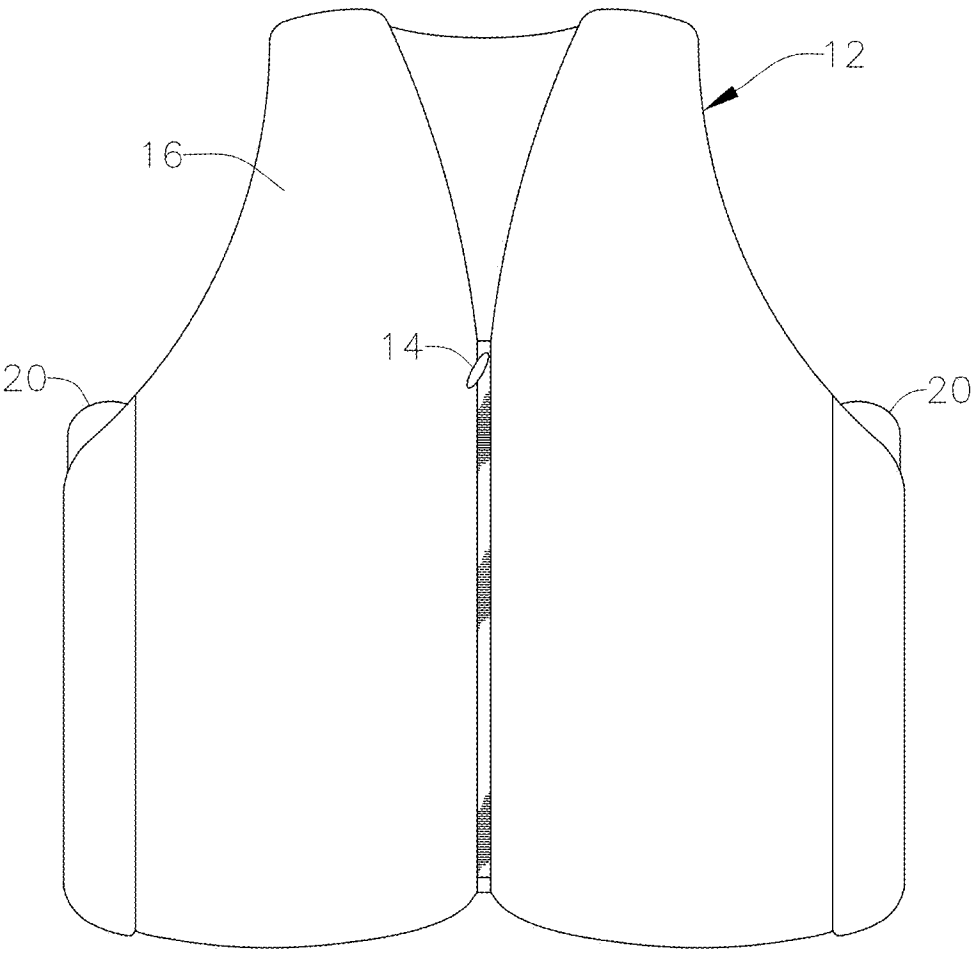
FIG. 1 is a perspective view of one embodiment of a hydro propulsion apparatus of the present invention.

Referring to FIG. 1, a perspective view of a hydro propulsion apparatus 10 according to one embodiment of the present invention is shown. Apparatus 10 is shown in the form of a vest 12, although it is anticipated that apparatus 10 may be any form of a garment or other means that a person may wear or somehow attach to his body while practicing the present invention.

Apparatus 10 is designed to be attached to a user's body in a reasonably secure manner. Apparatus 10 includes a securing means 14 that is selectively operable to secure or release the apparatus from the user's body. Apparatus 10 may be designed to be secured to or released from any part of the user's body, such as his torso, his waist, his thigh, his arm, or the like. In the embodiment shown, securing means 14 is a zipper that is selectively operable to secure or release vest 12 from the user's torso. In alternate embodiments, securing means 14 may be any other means known in the art that serves a similar purpose, such as plastic snaps, hook and loop material, straps, or the like.

In the embodiment shown, vest 12 has a body 16. Body 16 preferably comprises a flexible material for the user's comfort, and is preferably waterproof. Such material may be a plastic foam material such as PVC or polyethylene, neoprene, nylon, thermoplastic urethane, foam, cork, or the like. In one embodiment, the material of body 16 is a high buoyancy material that helps the user float while using the apparatus in water. Such materials are known in the art for making life jackets, floatation devices, and the like.

Figure 2:
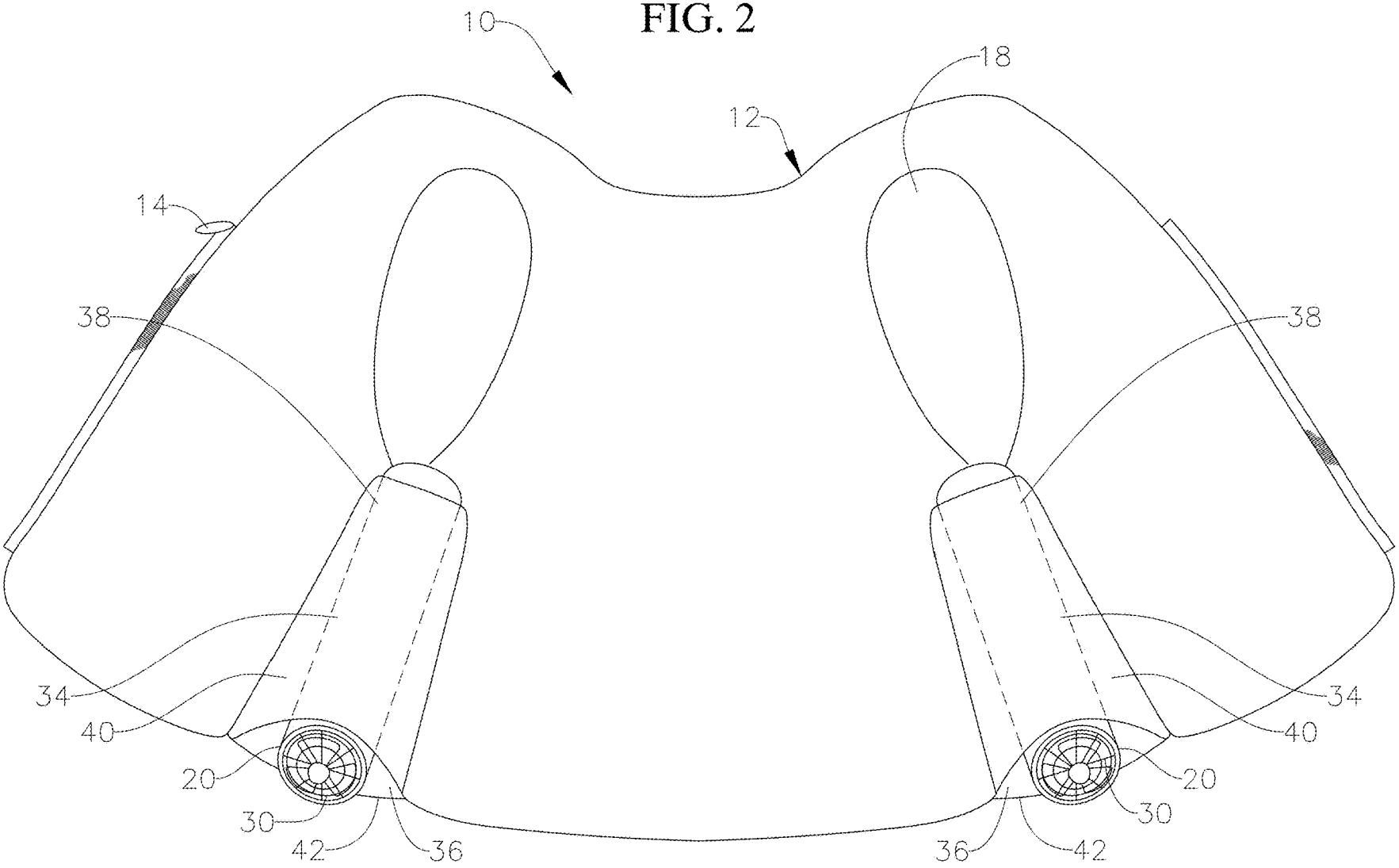
FIG. 2 is a perspective view of the apparatus of FIG. 1 shown in an alternate configuration.

Referring to FIG. 2, vest 12 is shown with its body 16 in an open configuration. This open configuration is accomplished by releasing closing means 14, whereby the body 16 of vest 12 can be opened. Vest 12 may be worn or removed by a user in such open position. In other embodiments, vest 12 may be worn or removed by a user by simply sliding it on or off from his body, similar to wearing or removing a t-shirt from the torso.

Body 16 of vest 12 comprises two openings, or cutouts 18. Cutouts 18 are provided to accommodate the user's arms through vest 12 when he wears vest 12. Cutouts 18 are designed to allow the user to swim or traverse through the water comfortably while wearing vest 12 without the apparatus impeding his mobility. Cutouts 18 are oval in shape as shown in FIG. 2, but it is anticipated that cutouts 18 may be of any shape that does not depart from the spirit and scope of the present invention.

Similarly, if apparatus 10 attaches to the user's body in a different manner, such as around the user's waist or on the user's thighs, it is anticipated that the corresponding body 16 of apparatus 10 will be designed and constructed accordingly to serve the objective of being worn and removed by the user.

Apparatus 10 comprises one or more propulsion units 20. Each propulsion unit 20 is operable to create a force in water, preferably a unidirectional force, to help propel apparatus 10 in water.

Propulsion unit 20 is electrically powered for its operation, typically with electrical power provided by a battery. In the preferred embodiment each propulsion unit 20 comprises its own battery that provides electrical power for it. The battery may be any form of battery known in the art that may serve the purpose of providing electrical power for the propulsion unit 20. The battery is preferably rechargeable, and is a Lithium Ion battery in one embodiment. In alternate embodiments the rechargeable battery may be a Nickel Metal Hydride battery, a Nickel Cadmium battery, a Sealed Lead Acid battery, or the like. In one embodiment, the battery is not a rechargeable battery but a regular battery, which may be discarded and replaced when its electrical charge is exhausted.

In one embodiment, the battery's charge lasts about 240 minutes for the operation of apparatus 10 in water. The battery's actual performance time will vary, and will typically depend on the user's specific usage of apparatus 10 and the charge capacity of the respective battery. Operating the apparatus 10 at faster speeds, for example, or with a heavier weight of the respective user, will result in shorter run times for the battery and a need for sooner recharges.

Figure 3:
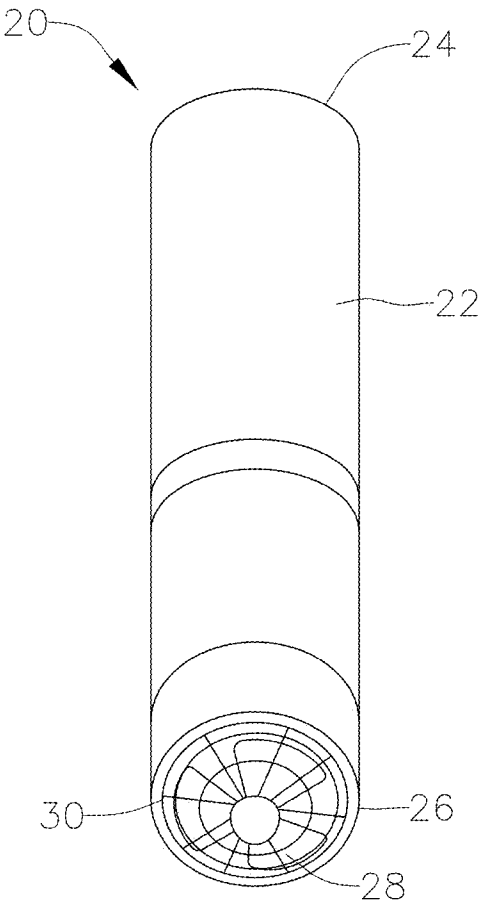
FIG. 3 is a perspective view of one embodiment of a propulsion unit in the apparatus of FIG. 1.

One embodiment of propulsion unit 20 is shown in FIG. 3. The propulsion unit 20 shown has a longitudinal cylindrical shape. However, it is anticipated that in alternate embodiments propulsion unit 20 may have a different shape or design. Propulsion unit 20 preferably has an ergonomic or streamlined shape in order to reduce drag and achieve more efficient propulsion in water. Such characteristics will help provide a longer battery life for apparatus 10 and accomplish faster speeds during use in water. Simultaneously, propulsion unit 20 must be designed to have a shape and size that will accommodate all of the various components and parts required for the functioning of propulsion unit 20. In that regard, it is anticipated that the shape and design of propulsion unit 20 will vary by embodiment. All different shapes and designs for propulsion unit 20 are anticipated, provided that they do not depart from the spirit and scope of the present invention.

Propulsion unit 20 has an outer body 22. In one embodiment outer body 22 is a casing that is preferably made of a resilient waterproof material. The material may be aluminum, another metal, plastic, or any other material known in the art that is appropriate for outer body 22. Outer body 22 creates a cavity that forms an interior of propulsion unit 20. Outer body 22 thus separates the interior of propulsion unit 20 from an exterior of propulsion unit 20. As shown in FIG. 3, the cavity in outer body 22 houses the various components of propulsion unit 20 in the interior of propulsion unit 20. Therefore, outer body 22 effectively serves as a protective shell, a waterproof shell, around the various components in propulsion unit 20. It is anticipated, however, that alternate embodiments of propulsion unit 20 may have one or more components positioned somewhere exterior of propulsion unit 20, i.e. somewhere on the exterior of outer body 22.

The interior of propulsion unit 20 includes a battery that is preferably housed protectively in the interior of propulsion unit 20, i.e. inside body 22. The battery provides electrical power, as necessary, to the various components of propulsion unit 20. The battery is preferably implemented substantially rigidly inside exterior body 22. In one embodiment, the battery is selectively removable and replaceable from propulsion unit 20.

Propulsion unit 20 comprises a propulsion means. The propulsion means serves to create a force in a particular direction, which propels apparatus 10 and anything attached to apparatus 10, such as a person. The propulsion means is implemented in the interior of propulsion unit 20 in one embodiment, although it may extend out from the interior in alternate embodiments. In one embodiment, the propulsion means is a propeller 28. Propulsion unit 20 comprises a motor attached to the propeller 28 that rotates the propeller 28 to generate thrust in water. The motor is electrically connected to the battery, which provides electrical power for the motor's operation.

Those skilled in the art will recognize that propeller 28 rotating in water will generate thrust, like a propeller on the engine of a motor boat. In such embodiment, propulsion unit 20 has an inlet means in a front section 24 that comprises an opening to allow water to flow into the interior of propulsion unit 20, and a rear section 26 that comprises an outlet means that allows water to flow out of the interior of propulsion unit 20. The rotation of propeller 28 will create such flow of water through the interior of propulsion unit 20.

In one embodiment, propulsion unit 20 comprises a propeller guard 30 at rear section 26. In one embodiment propeller guard 30 is a wire mesh or screen. Propeller guard 30 is designed to provide a protective barrier for propeller 28. One skilled in the art will appreciate that propeller guard 30 will help prevent accidental contact with the blades of the propeller 28, and therefore serves as a safety measure, especially during the operation of propulsion unit 20.

It is anticipated that alternate embodiments of propulsion unit 20 may utilize a different mechanism or a different technology to generate thrust as compared to a motor-driven propeller. Such alternate mechanism or different technology may be any relevant technology known in the art, or which may be invented hereafter, that helps serve the purpose of creating thrust or a propulsion force in water. All such mechanisms or technologies are anticipated and are intended to be covered by the claims as they are consistent with the spirit and scope of the present invention.

Propulsion unit 20 will typically include a switch means. The switch means helps turn the propulsion unit 20 on or off, and will therefore be electrically coupled with the motor, the battery, or both, in propulsion unit 20. In one embodiment, the coupling between the switch means and the battery or the motor is a simple electrical connection. In another embodiment, the coupling between the switch means and the battery or the motor is facilitated by an electronic control module implemented in the propulsion unit 20. Switch means that facilitate on/off functionality for electrically operated equipment are known in the art.

In one embodiment, the switch means also includes a means to control the speed of operation of propulsion unit 20. Switch means for controlling speed are known in the art, and are usually operable to control the speed of a motor. Such switch means include, for example, varying the switching rate of a network of field effect transistors (FETs), by varying the voltage on the armature of a brushed motor, by adjusting the timing of current pulses delivered to the windings of a brushless motor, and the like.

In one embodiment, the switch means is physically implemented on outer body 22 of propulsion unit 20. In alternate embodiments, the switch means is implemented elsewhere on apparatus 10. In another embodiment, the switch means is provided independently or apart from propulsion unit 20 whereby a user may operate and control it more conveniently, such as by holding the switch means in his hand in the form of a remote control device, by wearing it on his wrist or arm, or the like. The communication between the switch means and the propelling means may occur in any manner known in the art, such as through a wired electrical connection, via wireless communication, via bluetooth technology, or the like. In all such embodiments, however, the switch means is operable to control certain performance aspects of the propelling means such as speed, and the user can access and operate the switch means while using apparatus 10.

At least one propulsion unit 20 is attached to apparatus 10. In alternate embodiments, a plurality of propulsion units 20 are attached to apparatus 10. In such embodiments the plurality of propulsion units 20 may be identical or they may vary from each other in certain aspects. All such embodiments of apparatus 10 with one or more propulsion units 20 are anticipated as they are consistent with the spirit and scope of the present invention.

Propulsion unit 20 may be attached to apparatus 10 in any of a number of ways. In one embodiment, vest 12 comprises a pocket 34 that has a cavity 36. The dimensions of cavity 36 preferably correspond to the dimensions of propulsion unit 20 whereby cavity 36 can accommodate propulsion unit 20. Propulsion unit 20 is preferably selectively removable from cavity 36, such as by sliding it in and out of cavity 36 through an opening 42 in pocket 34. In other embodiments, pocket 34 may have flaps that facilitate the insertion or removal of propulsion unit 20 from cavity 36, where the flaps are held closed by any means, such as with straps, with a hook and loop material, with interlocking plastic snaps, or the like.

Pocket 34 preferably includes a retention means to help retain propulsion unit 20 inside cavity 36. The retention means will help prevent propulsion unit 20 from falling out of pocket 34, or from dislodging from pocket 34, during the use of apparatus 10. The retention means may be a flap that closes opening 42, a hoop and loop material with corresponding pieces implemented on the propulsion unit 20 and on pocket 34, threads in pocket 34 that cooperatively engage with threads on propulsion unit 20, a socket in pocket 34 that allows a part of the propulsion unit 20 to snap in, or the like. In one embodiment, the material of pocket 34 is stretchable whereby it expands to accommodate propulsion unit 20 in cavity 36 of pocket 34 and snugly holds propulsion unit 20 inside the cavity 36 while still allowing the user to selectively remove the propulsion unit 20 by stretching the material of pocket 34.

In one embodiment, a front portion 38 of pocket 34 is narrower than a rear portion 40 of pocket 34. This will allow propulsion unit 20 to be inserted into cavity 36 from the rear portion 40 of the pocket 34. In this embodiment an opening in the front portion 38 of pocket 34 is preferably narrower than a circumference of the propulsion unit 20.

Pocket 34 is preferably rigidly attached to apparatus 10. Pocket 34 may be attached to apparatus 10 in any manner known in the art that is appropriate for such attachment for use of apparatus 10 in water. In one embodiment, pocket 34 is sewn on to the vest 12. In another embodiment, pocket 34 is formed of the same material as the body 16 of vest 12. In one embodiment, pocket 34 is integrally formed with vest 12 and is a continuation of the material of its body 16. In an alternate embodiment, pocket 34 is formed by implementing a piece of material, such as a flap, on the inside of vest 12 under the arm area of a user wearing vest 12, whereby the piece of material forms a cavity that can accommodate propulsion unit 20. Accordingly, it is anticipated that propulsion unit 20 may be implemented in apparatus 10 by virtue of pocket 34 in any manner that is known in the art or that may hereafter be invented. AH such embodiments are consistent with the spirit and scope of the present invention, and are intended to be included in the present claims.

In some embodiments, two or more propulsion units 20 may be implemented in apparatus 10. Those skilled in the art will appreciate that the greater the number of propulsion units 20 implemented in apparatus 10, the greater the propulsion that apparatus 10 will achieve. Thus, a user wearing apparatus 10 in water will experience greater propulsion force with more propulsion units 20. Having more propulsion units 20 may also translate to the respective apparatus 10 achieving a higher speed in water.

In one embodiment, apparatus 10 comprises two propulsion units 20. FIG. 2 shows two propulsion units 20 implemented in vest 12. When a user wears vest 12, the two propulsion units 20 are positioned one on each side of the user's torso. One skilled in the art will appreciate that the two propulsion units 20, one on each side of the user's torso, will help provide a balanced propulsion force to the user's body in water.

In an alternate embodiment, a third propulsion unit 20 is implemented at about a midpoint of the body 16 of vest 12. In this embodiment, while the user is wearing vest 12, the third propulsion unit 20 will be positioned on the user's back. This third propulsion unit 20 will help provide yet more propulsion force to the user's body. Similarly, a propulsion unit 20 may be implemented on vest 12 whereby it will be positioned on the frontal area of the user's body when the user wears vest 12, such as next to the stomach or chest area. Accordingly, all such embodiments of a plurality of propulsion units 20 are anticipated.

In embodiments with a plurality of propulsion units 20, the propulsion units 20 are preferably implemented in apparatus 10 in an aligned parallel configuration with respect to each other. Such aligned parallel configuration will help the respective propulsion units 20 provide the respective apparatus 10 the best cumulative propulsion force possible.

Accordingly, apparatus 10 may have a different number of propulsion units in alternate embodiments, All such embodiments are anticipated as they are consistent with the spirit and scope of the present invention. With a plurality of propulsion units 20 implemented in apparatus 10, it is anticipated that a user wearing apparatus 10 may achieve a speed of about 1 mph to about 7 mph in water.

In one embodiment, apparatus 10 includes a safety member that helps secure apparatus 10 to the user's body during use in water. The safety member in one embodiment is a strap having two ends, which at one end extends from apparatus 10 and wraps around a part of the user's body and attaches to apparatus 10 at its other end. In one embodiment, the safety member is a strap having two ends that, at its first end, is attached to vest 12 towards the bottom of its body 16 at about the mid-point of the vest 12. During use, while the user is wearing vest 12, the strap can be looped around the user's crotch area and attach to vest 12 at the strap's second end. The safety member's second end may attach to vest 12 in any manner known in the art, such as with a hook and loop material, a plastic snap, or the like.

Figure 4:
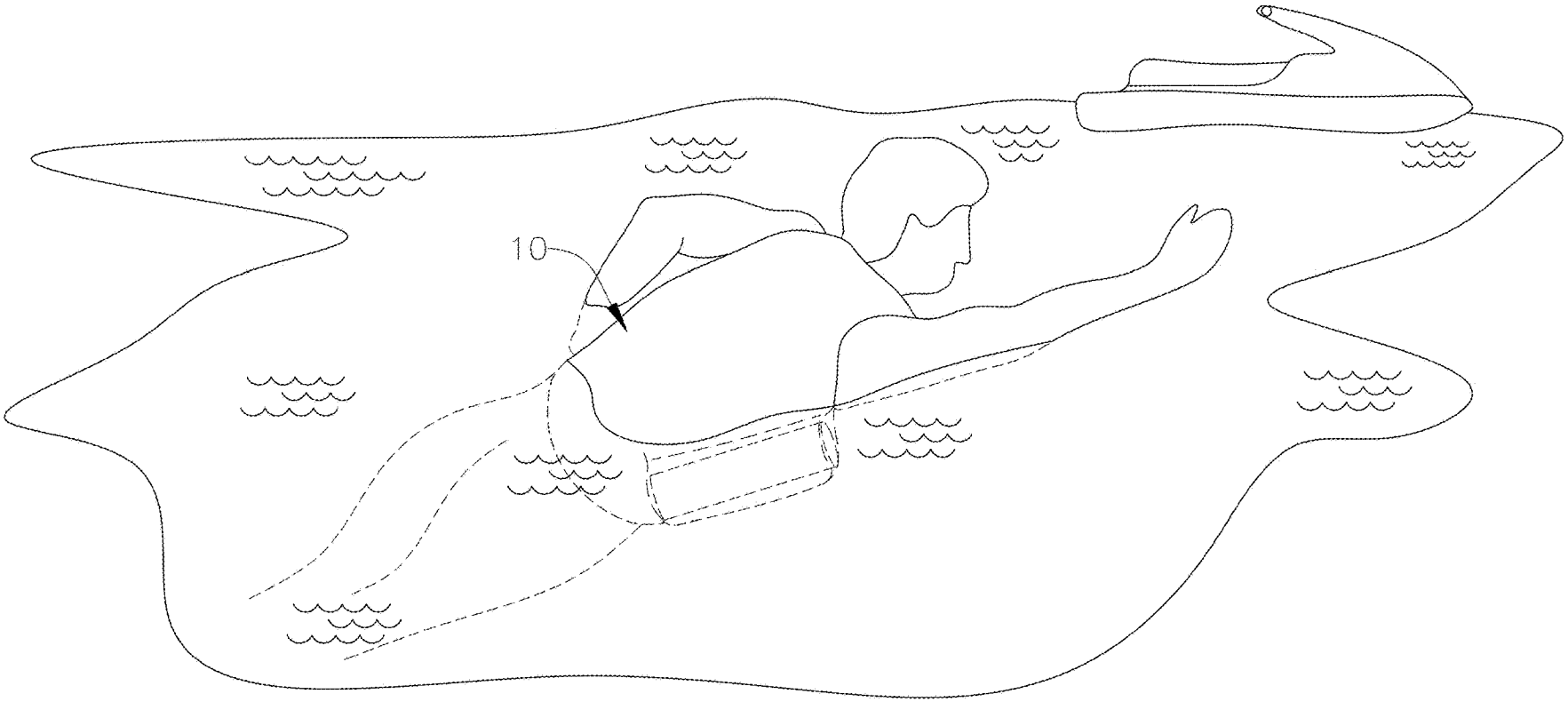
FIG. 4 is a perspective view of a user using the apparatus of FIG. 1 at the surface of a body of water.
Figure 5:
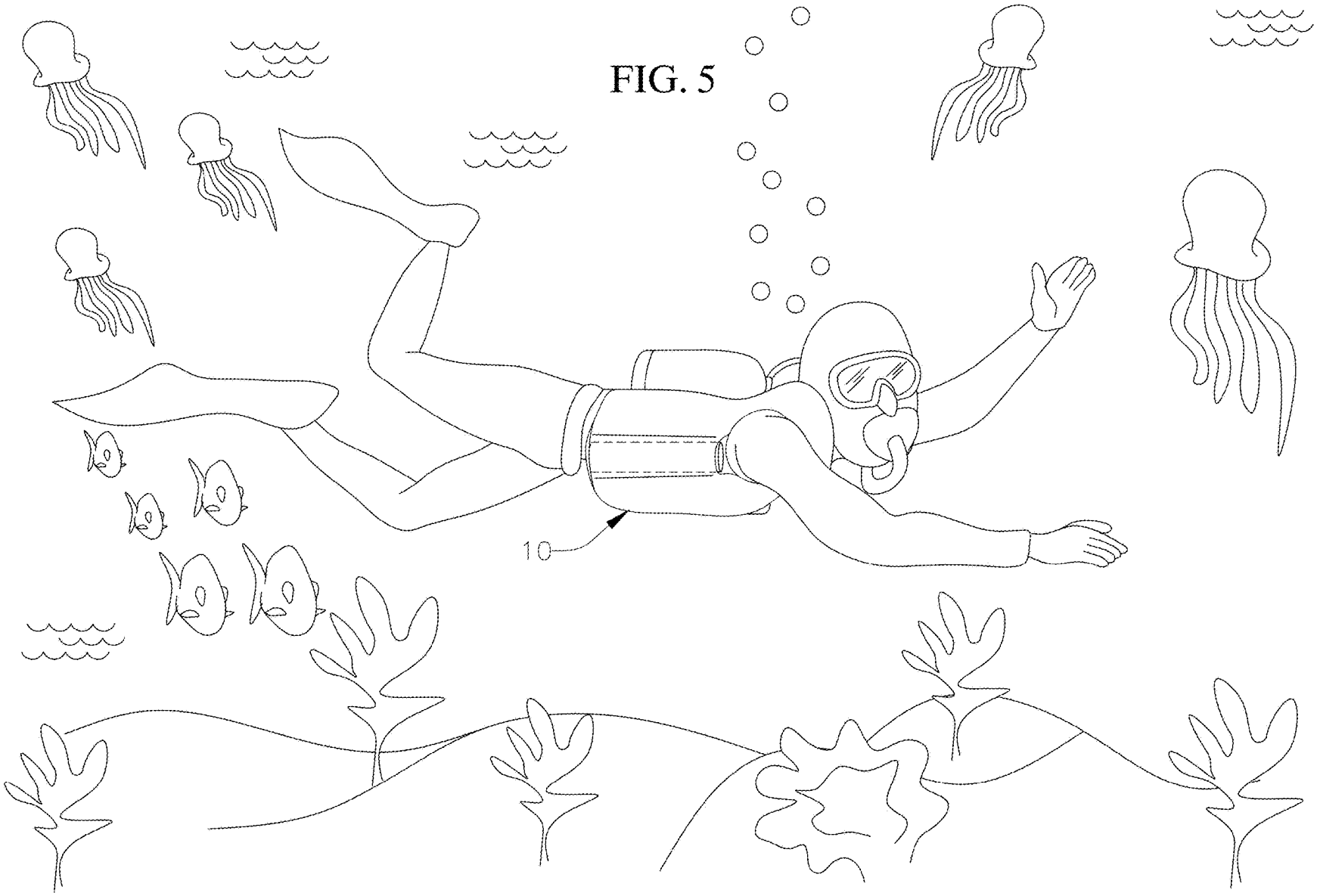
FIG. 5 is a perspective view of a person using the apparatus of FIG. 1 under water.

A user may propel himself in water while wearing apparatus 10. Apparatus 10 is functional for propulsion both under water and at the surface of a body of water. As shown in FIG. 4, the user may use the propulsion provided by apparatus 10 to help him travel in water. This may include, for example, a user traveling in water towards a boat, towards a jet ski, or the like. The user is able to swim while simultaneously being assisted with propulsion, which helps make his travel in water less strenuous. The propulsion is particularly helpful if the user is experiencing fatigue or exhaustion, whereby the user may turn apparatus on or off as desired. The user may even lie on his back and let apparatus 10 propel him. On the surface of the water, this configuration of travel will leave his face exposed above the water's surface, allowing him to breathe comfortably.

Alternatively, the user may engage in a water activity such as snorkeling, scuba diving, or the like, while wearing apparatus 10. Apparatus 10 will propel him as desired, without interfering with his equipment such as scuba gear. It is anticipated that a user will be able to engage in his activity over a larger area without tiring himself with strenuous swimming or propelling himself manually in the water. This will be especially helpful for the user's water activity if the user can control the speed at which apparatus 10 propels him in the water.

Apparatus 10 is shown in the form of a vest 12, for the likely use by a person, by a fatigued or injured swimmer, or the like. It is anticipated, however, that apparatus 10 and the present invention is also usable for animals, such as for a pet dog. This may be for recreational use, for rescue missions, or the like. The teachings of the present invention will apply the same, although the shape and design of apparatus 10 may need to be varied for the particular use.

Although the devices, systems, apparatus, and methods have been described and illustrated in connection with certain embodiments, variations and modifications will be evident to those skilled in the art. Such variations and modifications may be made without departing from the scope and spirit of the present disclosure, and are therefore anticipated. The description and teachings herein are thus not to be limited to the precise details of methodology or construction set forth herein because variations and modification are intended to be included within the scope and spirit of the present disclosures and teachings.

We claim:

1. A hydro propulsion apparatus, comprising:

an attachment unit in the hydro propulsion apparatus, said attachment unit operable to attach the hydro propulsion apparatus to a user's body;

a propulsion unit substantially rigidly attached to the hydro propulsion apparatus, wherein said propulsion unit comprises:

a battery; and a propulsion mechanism electrically connected to said battery, wherein said propulsion unit is selectively operable to generate a propulsion force in water; and a pocket attached to the hydro propulsion apparatus, wherein said pocket comprises:

a cavity, a front opening, and a rear opening, wherein said propulsion unit is removably positioned in said cavity, and said front opening and said rear opening are operable to allow a flow of water from said front opening to said rear opening when said propulsion unit is in operation.

2. The hydro propulsion apparatus of claim 1, wherein said propulsion unit comprises a casing that defines a cavity, wherein:

said battery is implemented in said cavity;

a motor is implemented in said cavity, wherein said motor is electrically connected to said battery; and said propulsion mechanism is operably connected to said motor.

3. The hydro propulsion apparatus of claim 2, wherein said propulsion mechanism is a propeller.

4. The hydro propulsion apparatus of claim 3, wherein the propulsion unit further comprises a propeller guard positioned in proximity with said propeller.

5. The hydro propulsion apparatus of claim 2, wherein said propulsion unit further comprises an inlet and an outlet, and said propulsion mechanism is operable to create a flow of water from said inlet to said outlet.

6. The hydro propulsion apparatus of claim 2, further comprising a first switch that is operable to turn said propulsion unit on or off.

7. The hydro propulsion apparatus of claim 6, further comprising a second switch that is operable to control a speed of said propulsion mechanism.

8. The hydro propulsion apparatus of claim 1, wherein said hydro propulsion apparatus comprises a vest that is wearable around a torso of the user.

9. The hydro propulsion apparatus of claim 8, wherein said attachment unit is one of a zipper, straps, or plastic snaps.

10. The hydro propulsion apparatus of claim 8, wherein said vest comprises a high buoyancy material.

11. The hydro propulsion apparatus of claim 1, wherein said pocket is formed integrally with the hydro propulsion apparatus.

12. The hydro propulsion apparatus of claim 1, further comprising a plurality of propulsion units substantially rigidly attached to the hydro propulsion apparatus, wherein said plurality of propulsion units are positioned in a substantially parallel configuration with respect to each other.

13. A method of traveling in water, comprising:

attaching a hydro propulsion apparatus to a user's body;

positioning a propulsion unit in a pocket of said hydro propulsion apparatus, said pocket comprising a cavity, a front opening, and a rear opening, wherein said propulsion unit is removably positioned in the cavity of said pocket; and generating a propulsion force in water with said propulsion unit substantially rigidly attached to said hydro propulsion apparatus, wherein:

a battery is implemented in said propulsion unit;

a motor is implemented in said propulsion unit, and said motor is electrically connected to said battery; and a propulsion mechanism is operably connected to said motor, and said propulsion mechanism is operable to generate thrust in water, wherein said front opening and said rear opening allow a flow of water from said front opening to said rear opening.

14. The method of traveling in water of claim 13, further comprising:

generating the propulsion force in water with a plurality of propulsion units substantially rigidly attached to said hydro propulsion apparatus, wherein said plurality of propulsion units are positioned in a substantially parallel configuration with respect to each other.

15. The method of traveling in water of claim 13, wherein said propulsion unit further comprises:

an inlet and an outlet, and said propulsion mechanism is operable to create a flow of water from said inlet to said outlet; and a switch electrically connected to said propulsion unit, wherein said switch is operable to control an operation of said propulsion unit.

16. The method of traveling in water of claim 13, wherein said hydro propulsion apparatus comprises a vest that is wearable by the user.

17. An apparatus for propelling a user in water, comprising:

a device wearable by the user, said device comprising a fastening unit operable to fasten said device to a part of the user's body;

at least one propulsion unit substantially rigidly attached to said device, said propulsion unit comprising a battery;

a propulsion mechanism electrically connected to said battery, wherein said propulsion mechanism is operable to create a propulsion force in water; and a pocket attached to said device, wherein said pocket comprises:

a cavity, a front opening, and a rear opening, wherein said propulsion unit is removably positioned in said cavity, and said front opening and said rear opening are operable to allow a flow of water from said front opening to said rear opening when said propulsion unit is in operation.

18. The apparatus of claim 17, wherein:

said propulsion mechanism is a propeller; and said device is a vest.

19. The apparatus of claim 18, further comprising two propulsion units, wherein:

the vest further comprises two pockets, and each pocket defines a cavity;

said vest comprises two opposite sides;

said two pockets are substantially rigidly implemented on the vest with one pocket on each of said two opposite sides of the vest; and each propulsion unit is substantially rigidly implemented in the cavity in the corresponding pocket.

* * * * *